United States Patent [19]

Ginisty et al.

[11] 4,432,946

[45] Feb. 21, 1984

[54] URANIUM (VI) RECOVERY PROCESS USING ACID ORGANOPHOSPHORUS EXTRACTANT CONTAINING TWO OR FOUR ALKOXYALKYL OR ARYLOXYALKYL RADICALS

[75] Inventors: Claude Ginisty, Villeneuve-le-Roi; Michel Marteau, Ballainvilliers; Bernard Mauborgne, Limours, all of France

[73] Assignee: Commissariat a l'Energie Atomique, Paris, France

[21] Appl. No.: 316,941

[22] Filed: Oct. 30, 1981

[30] Foreign Application Priority Data

Nov. 14, 1980 [FR] France ..... 80 24253

[51] Int. Cl.[3] ..... C01G 60/02

[52] U.S. Cl. ..... 423/10; 260/950; 260/951

[58] Field of Search ..... 423/10; 260/950, 951

[56] References Cited

U.S. PATENT DOCUMENTS

| | | | |
|---|---|---|---|
| 4,243,637 | 1/1981 | Bradford et al. | 423/10 |
| 4,282,188 | 8/1981 | Demarthe et al. | 423/10 |
| 4,356,153 | 10/1982 | Bathellier et al. | 423/10 |

FOREIGN PATENT DOCUMENTS

| | | | |
|---|---|---|---|
| 2442796 | 8/1980 | France | 423/10 |

OTHER PUBLICATIONS

Merritt, Robert C., *The Extractive Metallurgy of Uranium,* Colorado School of Mines Research Institute, 1971, pp. 201-203, TN 799, U7 M47.

*Primary Examiner*—Deborah L. Kyle
*Assistant Examiner*—Matthew A. Thexton

[57] ABSTRACT

Process for the recovery of uranium (VI) present in a phosphoric acid solution by contacting the latter with an organic solvent able to extract uranium, the organic solvent comprising a system of extractants constituted by a neutral phosphine oxide and an acid organophosphorus compound.

The process comprises a re-extraction stage for the uranium extracted in the organic solvent, said re-extraction stage being performed in a re-extraction apparatus comprising at least two stages in which the uranium-containing organic solvent is circulated in the said stages by introducing it into the first stage, an aqueous ammonium carbonate solution is circulated in counter-current with respect to the organic solvent in the said stages by introducing it into the final stage in a quantity such that it represents 50 to 80% of the stoichiometric quantity necessary for neutralizing the acid organophosphorus compound and for transforming the uranium present in the organic solvent into uranyl ammonium tricarbonate, ammonia being added in the form of a gas or an aqueous solution to the ammonium carbonate solution circulating in the first stage in order to keep the pH of the final stage as a value between 8 and 9.5 and preferably between 8 and 8.5.

11 Claims, 7 Drawing Figures

URANIUM (VI) RECOVERY PROCESS USING ACID ORGANOPHOSPHORUS EXTRACTANT CONTAINING TWO OR FOUR ALKOXYALKYL OR ARYLOXYALKYL RADICALS

BACKGROUND OF THE INVENTION

The present invention relates to a process for the recovery of the uranium (VI) present in phosphoric acid solutions and particularly in phosphoric acid solutions obtained from phosphatic ores.

It is known that phosphatic ores have by no means negligible uranium contents which, during the etching of such oars, with a sulphuric solution, pass into the phosphoric acid solution obtained. It is advantageous to recover the uranium present in these solutions, which form an additional significant uranium source.

The hitherto known processes for recovering the uranium present in such solutions generally involve extraction by means of appropriate organic solvents. Among the hitherto used solvents, good results have been obtained with solvents containing a synergistic mixture of extractants, e.g. mixtures of dialkylphosphoric acid and neutral phosphine oxide, such as those described in French Patent Application 2442 796, filed on 28.11.1978 by the Commissariat à l'Energie Atomique.

Although these extractant systems make it possible to obtain satisfactory results, research has been carried out to find new extractant systems able to obtain even higher uranium extraction levels.

BRIEF SUMMARY OF THE INVENTION

The present invention relates to a process for the recovery of uranium (VI) by means of an organic solvent, which makes it possible to obtain better uranium extraction levels than the hitherto known solvents.

The present invention therefore relates to a process for the recovery of uranium (VI) present in a phosphoric acid solution by contacting the said solution with an organic solvent able to extract the uranium, wherein the organic solvent consists of a system of extractants respectively constituted by:

a neutral phosphine oxide of formula:

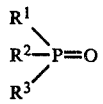

(I)

in which $R^1$, $R^2$ and $R^3$, which are the same or different, represent alkyl, aryl or alkoxyalkyl radicals, and an acid organophosphorus compound in accordance with the following formula:

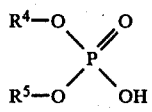

(II)

in which $R^4$ and $R^5$, which can be the same or different, represent a straight or branched-chain alkoxyalkyl radical containing at least ether oxide function or an aryloxyalkyl radical.

According to the invention, the alkoxyalkyl radical advantageously has 9 to 23 carbon atoms.

According to the invention, the acid organophosphorus compound can be a phosphoric ester of secondary alcohol or a phosphoric ester of primary alcohol. In the case of phosphoric esters of primary alcohol, the latter are advantageously in accordance with the formula:

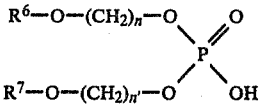

(III)

in which $R^6$ and $R^7$, which are the same or different, are alkyl or aryl radicals and n and n', which are the same or different, are numbers equal to 2 or 3.

Thus, it has been found that in the case of esters of primary alcohols, the presence of several ether oxide functions does not improve the results obtained and that, in addition, the extracting power increases when the ether oxide function is closer to the phosphate group. In addition, n and n' are preferably equal to 2.

Furthermore, if it is desired to re-extract the uranium by means of an aqueous solution such as a solution of ammonium carbonate and ammonia, it is preferable for the alkyl radicals $R^6$ and $R^7$ to have at least 8 carbon atoms for preventing the formation of a third phase during the said re-extraction.

Among the compounds which may be used, reference is made to the compound in which $R^6$ and $R^7$ represent the ethyl-2-hexyl radical and n and n' are equal to 2.

The acid organophosphorus compound can also be constituted by a phosphoric ester of secondary alcohol according to formula IV:

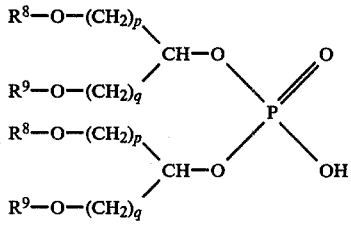

(IV)

in which $R^8$ and $R^9$, which are the same or different, represent an alkyl or aryl radicals, and p and q, which can be the same or different, are equal to 1 or 2.

Preferably, p and q are equal to 1, because the extracting power of the system increases when the ether oxide function of the acid organophosphorus compound is close to the phosphate group.

Moreover, in order to also permit the re-extraction of the uranium in an aqueous solution of ammonium carbonate and ammonia, the radicals $R^8$ and $R^9$ preferably have at least four carbon atoms to prevent the formation of a third phase during this re-extraction.

As an example of a phosphoric ester of secondary alcohol which can be used, reference is made to the compound of formula (IV) in which p and q are equal to 1 and $R^8$ and $R^9$ represent the butyl radical.

Thus, re-extraction tests carried out by using as a system of extractants the compound of formula (IV) in which $R^8$ and $R^9$ represent the propyl radical and p and q are equal to 1, together with di-n-hexyloctoxymethylphosphine oxide (POX 11) have shown that the solubility of the alkali metal salts of this acid compound is such that it leads to the formation of a third phase. Conversely, on increasing the number of carbon atoms of the alkyl chains of this acid compound, the aforementioned phenomenon can be prevented.

The acid organophosphorus compounds of formulas (III) or (IV) used in the process of the invention can be obtained by transesterification or esterification of a phosphorus derivative with the corresponding alkoxy alcohol, said reaction being optionally followed by an oxidation and/or a hydrolysis.

As phosphorus derivatives, it is possible to use dialkylphosphorous acid, phosphorus oxychloride or phosphorus pentoxide $P_2O_5$.

When the phosphorus derivative is a dialkylphosphorous acid the transesterification reaction with the corresponding alkoxy alcohol is followed by an oxidation reaction, then a hydrolysis to give the corresponding acid organophosphorus compound. Oxidation can be carried out by the action of sulphuryl chloride $SO_2Cl_2$ and the hydrolysis by the action of soda and hydrochloric acid.

Thus, in the case when a diethylphosphorous acid is used for the preparation of compounds of formula (IV) with $R^8=R^9$ and n=p, the reaction diagram being as follows:

$$2\,[R^8-O-(CH_2)_9]_2CHOH + (C_2H_5O)_2-POH \longrightarrow [R^8-O-(CH_2)_p-CHO]_2-POH + 2C_2H_5OH \quad (1)$$

$$[R^8-O-(CH_2)_p-CHO]_2-POH + SO_2Cl_2 \longrightarrow [R^8-O-(CH_2)_p-CHO]_2-\underset{\underset{O}{\|}}{P}-Cl + SO_2 + HCl \quad (2)$$

$$[R^8-O-(CH_2)_p-CHO]_2-\underset{\underset{O}{\|}}{P}-Cl + 2NaOH \longrightarrow [R^8-O-(CH_2)_p-CHO]_2-\underset{\underset{O}{\|}}{P}-ONa + NaCl + H_2O$$

-continued $$[R^8-O-(CH_2)_p-CHO]_2-\underset{\underset{O}{\|}}{P}-ONa + HCl \longrightarrow NaCl + [R^8-O-(CH_2)_p-CHO]_2-\underset{\underset{O}{\|}}{P}-OH \quad (4)$$

To obtain compound of formula (IV) in which $R^8$ and $R^9$, as well as p and q are different, it is merely necessary to replace in the aforementioned reaction diagram the secondary alcohol used by the secondary alcohol of the following formula:

$$R^8-O-(CH_2)_p-CHOH-(CH_2)_q-O-R^9$$

In the same way, when it is desired to prepare compounds of formula III, it is clearly necessary to replace in the above reaction diagram the secondary alcohol used by two identical molecules of primary alcohol of formula:

$$R^6-O-(CH_2)_{n-1}-CH_2OH$$

or by two different molecules of primary alcohols in the case where it is desired to obtain a compound of formula III in which $R^6$ and $R^7$ and optionally n and n' differ. In the latter case, it is necessary to carry out a purification of the products obtained to separate the desired compound.

When the phosphorus derivative is phosphorus oxychloride ($POCl_3$), the esterification reaction is carried out with the corresponding alkoxy alcohol in the presence of a base, particularly a tertiary organic base. The product obtained then undergoes a hydrolysis, so that a mixture of monoacids and diacids is obtained, which is then separated.

To obtain compounds of formula IV in which $R^8$ and $R^9$, as well as p and q are identical, the reaction diagram is as follows:

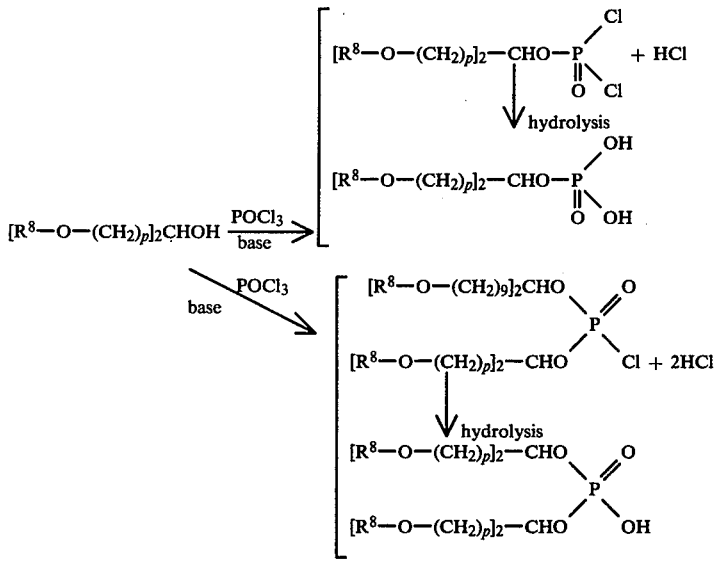

In the case where it is desired to obtain compounds of formula IV in which $R^8$, $R^9$, p and q are different, the starting products used is the corresponding secondary alcohol of formula:

$$R^8—O—(CH_2)_p—CHOH—(CH_2)_q—O—R^9$$

When it is desired to obtain the compound of formula III in which $R^6$ and $R^7$ differ, two molecules of corresponding alcohols are used and the products obtained are subject to a separation process to separate the corresponding monoacid from the monoacid-diacid mixture obtained.

On starting with a phosphorus derivative, constituted by phosphorus pentoxide $P_2O_5$, esterification is carried out with the corresponding alkoxy alcohol whilst protected from moisture. In this way, a monoacid-diacid mixture is obtained, which may also contain a neutral phosphate and impurities such as pyrophosphates and polymers. and polymers.

The alkoxy alcohols used as starting products for the synthesis of acid organophosphorus compounds can be prepared by reacting a sodium alkoxide with a dichloro derivative or a secondary alcohol, e.g. sodium alkoxide with 1,3-dichloro-2-propanol, in accordance with the following reaction diagram:

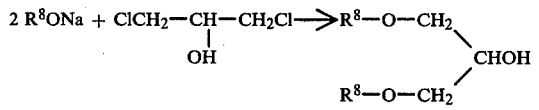

When it is desired to obtain primary alkoxy alcohols, a sodium alkoxide is reacted with a chloro derivative of a primary alcohol.

According to the invention, the neutral phosphine oxide according to formula I preferably contains at least one alkoxyalkyl radical, e.g. an alkoxymethyl radical having 4 to 12 carbon atoms. When the other radicals are alkyl radicals, the latter generally have 4 to 12 carbon atoms and are preferably straight-chained.

Examples of such neutral phosphine oxides which can be used are di-isobutyl-octoxymethyl phosphine oxide, di-n-butyl-octoxymethylphosphine oxide, di-n-pentyl-octoxymethylphosphine oxide and di-n-octoxymethylphosphine oxide (POX 11).

These phosphine oxides can be prepared by reacting a halomagnesium salt of secondary phosphine oxide with an organic halide of formula RX in which R represents an alkoxyalkyl radical, e.g. a chloromethyl-n-octylic ether, as described in French Pat. No. 2,346,361, filed on 13.12.1973.

In the process of the invention, it is also possible to use trialkylphosphine oxides in which the alkyl radicals have 4 to 14 carbon atoms, e.g. tri-n-octylphosphine oxide (TOPO).

For performing the process of the invention, the system of extractants is generally resolved in an inert organic solvent constituted, for example, by a saturated hydrocarbon having at least 8 carbon atoms such as dodecane, or by a mixture of hydrocarbons.

In the organic solvent, the acid organophosphorus compound and neutral phosphine oxide concentrations are advantageously such that the molar ratio of the acid organophosphorus compounds to the neutral phosphine oxide is between 1 and 9 and preferably 2 to 4.

It is pointed out that the process according to the invention can be performed in any conventional extraction apparatus such as mixer-settler rows, pulsed columns, centrifugal extractors, etc.

According to the invention, the uranium extracted in the organic solvent can be subsequently re-extracted in an aqueous phosphoric acid solution optionally containing a reducing agent so as to reduce the uranium (VI) into uranium (IV) to facilitate its re-extraction.

According to the invention, it is preferable to carry out the uranium re-extraction in a reextraction apparatus, comprising at least two stages. In this case the uranium-containing organic solvent is circulated in the said stages by introducing it into the first stage, an aqueous ammonium carbonate solution is circulated in countercurrent with respect to the organic solvent in the said stages by introducing it into the final stage in a quantity such that it represents 50 to 80% of the stoichiometric quantity necessary for neutralizing the acid organophosphorus compound and for transforming the uranium present in the organic solvent into uranyl ammonium tricarbonate, ammonia being added in the form of a gas or an aqueous solution to the ammonium carbonate solution circulating in the first stage in order to keep the pH of the final stage as a value between 8 and 9.5 and preferably between 8 and 8.5.

Preferably, the ammoniated organic solvent leaving the final re-extraction stage is reacidified by reacting it with an acid to eliminate the ammonium in the form of an ammonium salt and the thus reacidified organic solvent is reused for performing the uranium extraction.

Advantageously, the acid is chosen from the group containing sulphur, hydrochloric and phosphoric acids.

Preferably, the ammoniated organic solvent leaving the final re-extraction stage is reacidified by reacting it with the phosphoric acid recovered at the end of the uranium extraction.

This preferred uranium re-extraction procedure makes it possible to obtain at the end of re-extraction an aqueous uranium solution from which it is easily possible to directly recover the uranium corresponding to the standards defined by the refiners, consequently without any complementary purification cycle, either in the form of an oxide, or in the form of alkali metal or earth alkaline uranate, with an overall uranium recovery yield exceeding 90%.

Moreover, it leads to the formation of reusable products. Thus, the organic solvent reacidified by treatment with phosphoric acid can be reused for the extraction of the uranium and the ammonium phosphate obtained during the reacidification treatment of the organic solvent is a commercially usable product or a product which can be recycled, e.g. in a fertiliser unit.

According to the invention, the uranium re-extraction preferably takes place in three stages. In this case, the uranium-containing organic solvent is circulated from the first to the third stage and into the latter is introduced an aqueous ammonium carbonate solution or a mixture of carbon dioxide and ammonia previously dissolved in water in the form of carbonate representing 50 to 80% of the stoichiometric quantity necessary for neutralizing the acid organophosphorus compound of the organic solvent and for transforming the uranium into uranyl ammonium tricarbonate. This solution circulates from the third to the first stage and before it enters the first stage ammonia is added thereto in the form of a gas or an aqueous solution, the added quantity being such that the pH of the first stage is maintained at a value between 8 and 8.5.

In the case of pH levels below 8, the uranium re-extraction level decreases, whilst for pH levels above 8.5, the ammonia quantity introduced leads to the formation of emulsions, without bringing about any improvement in the uranium re-extraction level.

Preferably, ammonia is added in the form of an aqueous solution having an ammonia molar concentration of 5 M to 7.5 M.

In these stages, the uranium-containing organic solvent, which also contains iron, gradually transforms in contact with the ammonia into an ammonium salt and the aqueous phase moving in countercurrent is enriched with uranium and iron, the ammonium carbonate forming with the uranium uranyl ammonium tricarbonate which remains in solution and the iron is converted into ferric hydroxide, which precipitates and which can be separated by settling from the aqueous phase.

On leaving the third stage, the ammoniated organic solvent is preferably reacidified by treating with an acid such as sulphuric acid, hydrochloric acid or phosphoric acid, which makes it possible to recover an organic phase which no longer contains ammonium ions and an aqueous phase containing an ammonium salt.

Preferably, for this particular treatment, a fraction of the phosphoric acid recovered at the end of the uranium extraction stage is used.

BRIEF DESCRIPTION OF THE DRAWINGS

The invention is described in greater detail hereinafter relative to non-limitative exemplified embodiments and with reference to the attached drawings, wherein show.

EXEMPLIFIED EMBODIMENTS OF THE INVENTION

EXAMPLE 1

Figure 1:
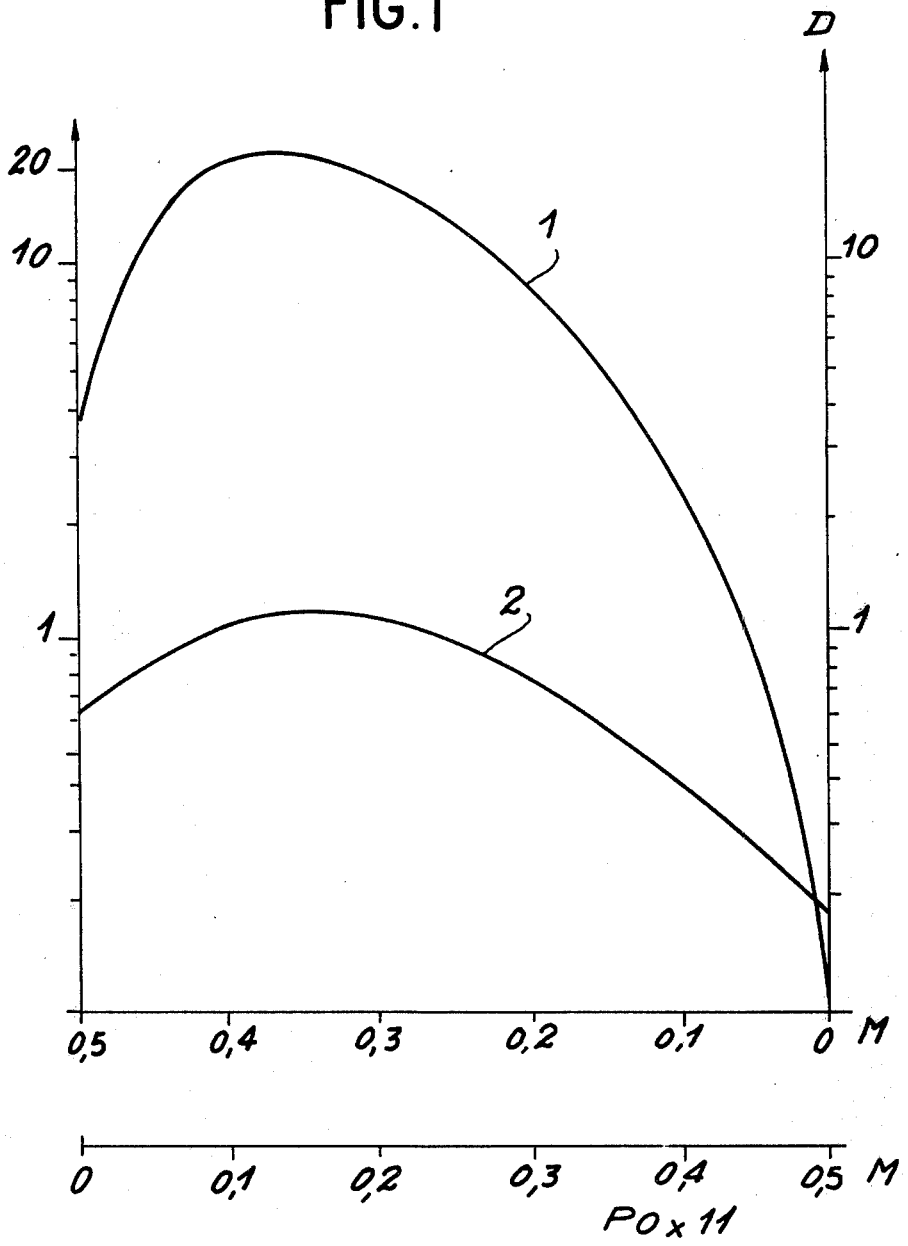
FIG. 1 variations in the coefficient of partition D of uranium (curve 1) and iron (curve 2) as a function of the respective extractant contents of the organic solvent.

This example relates to the recovery of the uranium present in a 6 M phosphoric acid solution containing 1 g/l of uranium (VI) and illustrates the effect of temperature and the nature of the system of extractants on the uranium extraction level.

In this example, the different acid organophosphorus compound of table I are used with trioctylphosphine oxide (TOPO) or di-n-hexyl-octoxymethyl phosphine oxide (POX 11). The two extractants are diluted in Hyframe 120, which is a branched saturated hydrocarbon with on average 12 carbon atoms and the acid organophosphorus compound content of the solvent is 0.5 M and its phosphine oxide content is 0.125 M.

Extraction is performed under the following conditions. One volume of the aqueous phosphoric acid solution and one volume of the organic solvent are contacted at 23° or 40° C. for 15 minutes. The two phases are mechanically stirred and separated by centrifuging. This is followed by sampling and analysis of each of the phases in order to determine its uranium concentration, the latter being measured by dibenzoyl methane spectrophotometry. The uranium is previously extracted in a trioctylphosphine oxide solution. The coefficient of partition D of the uranium is then determined and this is equal to the ratio of the uranium concentration of the organic phase to the uranium concentration of the aqueous phase. The results are given in the attached table 1. On the basis of these results, it is apparent that the synergism effect is greatest in the case of compounds 7 and 8, which are phosphoric esters of secondary alcohols. However, the synergism effect is also very great in the case of compounds 3 and 5 in which the ether oxide function is close to the phosphate group.

It is also apparent that the introduction of two ether oxide functions makes it possible to improve the results when these two functions are introduced sufficiently close to the phosphate group as in the case of compounds 7 and 8, whereas the effect obtained with two linear functions (compound 6) is poor.

In all cases, the uranium partition coefficient increases with the number of carbon atoms in the alkoxy chains.

It is pointed out that compounds 7 and 8 of table 1 were obtained in the following manner.

A preparation of bis-(1,3-dibutoxy-2-propyl)-phosphoric acid (compound 8 hereinafter called HBIDIBOPP).

$$[(C_4H_9OCH_{22}-CHO]_2-\underset{\underset{O}{\|}}{P}-OH$$

(a) preparation of 1,3-dibutoxy-2-propanol $$2C_4H_9ONa + ClCH_2-\underset{\underset{OH}{|}}{CH}-CH_2Cl \longrightarrow C_4H_9OCH_2-\underset{\underset{OH}{|}}{CH}-CH_2OC_4H_9 + 2NaCl$$

99 g of 90% soda pellets (i.e. 2.23 moles) are dissolved hot, accompanied by stirring in 1665 g of anhydrous butanol (i.e. 22.5 moles). When the soda is completely solubilized, cooling takes place and at ambient temperature 139 g of 1,3-dichloro-2-propanl (i.e. 1.08 mole) are poured. The reaction is not exothermic. When pouring is at an end, refluxing takes place for 1 hour. A sodium chloride precipitate forms. Cooling takes place, followed by filtering and expulsion of the excess butanol. The residue is washed twice with water. Extraction takes place with ether, following by drying on magnesium sulphate and expulsion of the ether. The residue is distilled; boiling point 110° to 112° C./15 mm Hg. 143 g of product are recovered with a yield of 65%.

(b) Preparation of bis-(1,3-dibutoxy-2-propyl)-phosphorus acid by transesterification:

$$2(C_4H_9OCH_2)_2CHOH + (C_2H_5O)_2POH \rightarrow [(C_4H_9OCH_2)_2CHO]_2POH + 2C_2H_5OH$$

143 g of 1,3-dibutoxy-2-propanol (i.e. 0.7 mole) and 48.36 g of diethyl phosphorus acid (i.e. 0.35 mole) are placed under an argon stream also in a balloon flask for distillation with a Vigreux column. Progressively, heating takes place up to about 150° C. in an oil bath and the ethanol distils. This temperature is maintained during the distillation of the alcohol and is then progressively raised to 180° C. Cooling is allowed to take place, followed by vacuum distillation of the light products and those which have not reacted. 25 g of ethanol (yield 78%) and 150 g of crude acid (yield 94%) are recovered.

(c) Oxidation and preparation of the acid chloride:

$$[(C_4H_9OCH_2)_2CHO]_2{-}POH + SO_2Cl_2 \longrightarrow [(C_4H_9OCH_2)_2CHO]_2{-}\underset{\underset{O}{\|}}{P}Cl + SO_2 + HCl$$

150 g of the above acid (i.e. 0.33 mole) and 150 ml of benzene are placed in a reactor, followed by cooling to 0° C. Dropwise pouring takes place, accompanied by stirring, of a sulphuryl chloride solution prepared from 44.27 g of $SO_2Cl_2$ (i.e. 0.33 mole) and 50 ml of benzene so as to maintain the temperature at between 0° and 5° C. When pouring is at an end, the temperature is progressively allowed to rise, followed by degasing the mixture by means of nitrogen for 1 hour. The solvent is expelled in vacuo and 160 g of a viscous residue are recovered, with a yield of approximately 100%.

(d) Preparation of bis-(1,3-dibutoxy-2-propyl)-phosphoric acid:

$$[(C_4H_9OCH_2)_2CHO]_2{-}\underset{\underset{O}{\|}}{P}Cl + 2NaOH \longrightarrow [(C_4H_9OCH_2)_2CHO]_2\underset{\underset{O}{\|}}{P}{-}ONa + NaCl + H_2O$$

$$[(C_4H_9OCH_2)_2CHO]_2{-}\underset{\underset{O}{\|}}{P}{-}ONa + HCl \longrightarrow [(C_4H_9OCH_2)_2CHO[_2{-}\underset{\underset{O}{\|}}{P}OH + NaCl.$$

160 g of the above chloride (i.e. 0.33 mole) and 150 ml of water are placed in the reactor (non-homogeneous mixture). Cooling takes place to between 0° and 5° C. and 165 ml of 4 N soda (i.e. 0.66 mole) are poured dropwise. The reaction is not exothermic and the insoluble sodium salt is formed. When pouring is at an end, the mixture is left at ambient temperature, accompanied by stirring, for 1 hour, followed by heating to 40° to 50° C. for 1 hour. After cooling, the acid is removed from its sodium salt by means of a strong acid (e.g. HCl). 140 g of product are recovered with a yield of 88%.

Characterization of the product

Determination of the purity by potentiometry
monoacid: 97.72%
diacid: 2.52%
I.R.: $\nu(P{=}O) = 1235\ cm^{-1}$
NMR'H: confirmation of the structure.

| Group | $CH_3$— | —$CH_2$— | O—$CH_2$ | O—CH | OH |
|---|---|---|---|---|---|
| δ (in ppm) | 0.93 | 1.47 | 3.56 | 4.51 | 10.81 |
| Intensity | 12 | 16 | 16 | 2 | 1 |
| Multiplicity | triplet | solid structure | solid structure | solid structure | singlet |

elementary analysis

| $C_{22}H_{47}O_8P$ | calculated | found |
|---|---|---|
| C % | 56.15 | 54.30–54.11 |
| H % | 10.07 | 10.21–10.04 |

B. Preparation of bis-(1,3-dipropoxy-2-propyl) phosphoric acid (compound 7)

$$[(C_3H_7OCH_2)_2{-}CHO]{-}\underset{\underset{O}{\|}}{P}(OH)(OH) \quad \text{et} \quad [(C_3H_7OCH_2)_2{-}CHO]_2{-}\underset{\underset{O}{\|}}{P}{-}OH$$

(a) Preparation of 1,3-dipropoxy-1-propanol $$2C_3H_7ONa + ClCH_2{-}\underset{\underset{OH}{|}}{CH}{-}CH_2Cl{-}C_3H_7OCH_2{-}\underset{\underset{OH}{|}}{CH}{-}CH_2OC_3H_7 + 2NaCl.$$

91 g of 90% soda pellets (i.e. 2.05 moles) are dissolved hot in 21 moles of anhydrous propanol. When the soda is entirely solubilized, cooling is allowed to take place and at ambient temperature 129 g of 1,3-dichloro-2-propanol (i.e. 1 mole) are poured in. When pouring is at an end, refluxing takes place for 1 hour. The sodium chloride precipitate forms. Cooling takes place, followed by filtration and expulsion of the excess propanol. The residue is washed twice with water, extracted in ether, dried on magnesium sulphate and the ether expelled. The residue is distilled. Boiling point 96°–100° C./15 mm Hg. 105 g of product are recovered with a yield of approximately 60%.

(b) Preparation of bis and mono-(1,3-dipropoxy-2-propyl)phosphoric acids by esterification of phosphorus oxychloride:

$$(C_3H_7OCH_2)_2CHOH + POCl_3 + C_5H_5N{-}C_5H_5N.HCl + (C_3H_7OCH_2)_2CHO\underset{\underset{O}{\|}}{P}Cl_2$$

and/or $$2(C_3H_7OCH_2)_2CHOH + POCl_3 + {}_2C_5H_5N \longrightarrow {}_2C_5H_5N.HCl + [(C_3H_7OCH_2)_2CH0]_2{-}\underset{\underset{O}{\|}}{P}Cl$$

0.6 mole of alcohol (105 g), 0.6 mole of pyridine (i.e. 47 g) and 150 ml of dry benzene are placed in a reactor. An argon stream is introduced and cooling takes place between 0° and +5° C. 0.25 mole of $POCL_3$ (i.e. 37 g) is poured into 50 ml of benzene so as to keep the temperature below 10° C. When pouring is at an end, stirring takes place for 2 hours allowing the temperature to return to ambient temperature and the mixture is left to stand for 16 hours.

(c) Hydrolysis and purification:

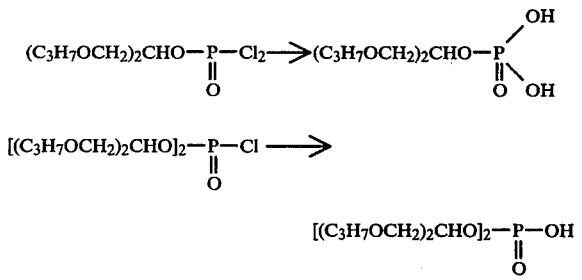

The product from the previous stage (b) is stirred with 150 ml of 2 N hydrochloric acid for 5 minutes. The acid layer is separated and then the organic phase is washed twice with 250 ml of N hydrochloric acid. Stirring takes place for 3 minutes on each occasion. The aqueous phase is decanted. The organic phase is stirred with 60 ml of 3 N hydrochloric acid in a beaker, accompanied by electromagnetic stirring at a temperature of 90° C. for 3 hours. The benzene is evaporated during this operation and all the P-Cl bonds are completely destroyed, together with most of the P-O-P-pyrophosphate bonds. Cooling is allowed to take place and the acid phase decanted. The organic phase is transferred into a balloon flask and the alcohol and water are eliminated by vacuum distillation at 0.05 mm Hg (the bath temperature being maintained at 60°-65° C.). With distillation at an end, the viscous organic phase is refluxed with 60 ml of 3 N HCl for 48 hours so as to complete the destruction of the P-O-P bridges.

Cooling is allowed to take place, followed by the decanting of the acid aqueous layer and the addition of 300 ml of heptane. Vigorous stirring takes place for 3 minutes and then the organic layer is extracted by means of 9 portions of 60 ml of ethylene glycol, whilst leaving in contact for about 3 minutes on each occasion. The glycol extracts the mono derivative formed.

The glycol is decanted and then the heptane solution is washed three times with 150 ml of distilled water. The organic phase is dried and the solvent expelled. In this way, bis-(1,3-dipropoxy-2propyl)-phosphoric acid is recovered.

Characterization

Potentiometric determination: single acidity-purity at 98%.

Volumetric determination with soda (phenolphthalein) purity 96.5%

NMR of the proton: according to formula.

| Group | $CH_3$ | $CH_2$ | $CH_2O$ | CHO |
|---|---|---|---|---|
| δ (ppm) | 0.77 | 1.44 | 3.31 | 4.24 |
| intensity | 12 | 8 | 16 | 2 |
| Multiplicity | Triplet | Multiplet | Multiplet | Multiplet |

EXAMPLE 2

In this example, the influence of the respective acid organophosphorus compound and neutral phosphine oxide contents on the uranium extraction is studied. The organic solvent is constituted by Hyfrane 120 containing a mixture of bis-(1,3-dibutoxy-2-propyl) hydrogen phosphate, i.e. compound 8 of table 1 and di-n-hexyloctoxymethylphosphine oxide (POX 11) for the recovery of the uranium from a 6 N phosphoric acid solution containing 1.1 g/l of uranium (VI). In each case, a total extractant concentration of 0.5 M is used and extraction is carried out under the same conditions as in example 1.

The results obtained are given on curve 1 in FIG. 1, which represents the variations of the uranium partition coefficient D as a function of the acid organophosphorus compound content of the organic solvent. In FIG. 1, curve 2 represents the variations of the iron partition coefficient D as a function of the content of the compound realises the extraction under the same conditions from a 6 M phosphoric acid solution containing 1.1 g/l of iron (III). It is pointed out that the iron content of the two phases was determined by atomic absorption.

Figure 2:
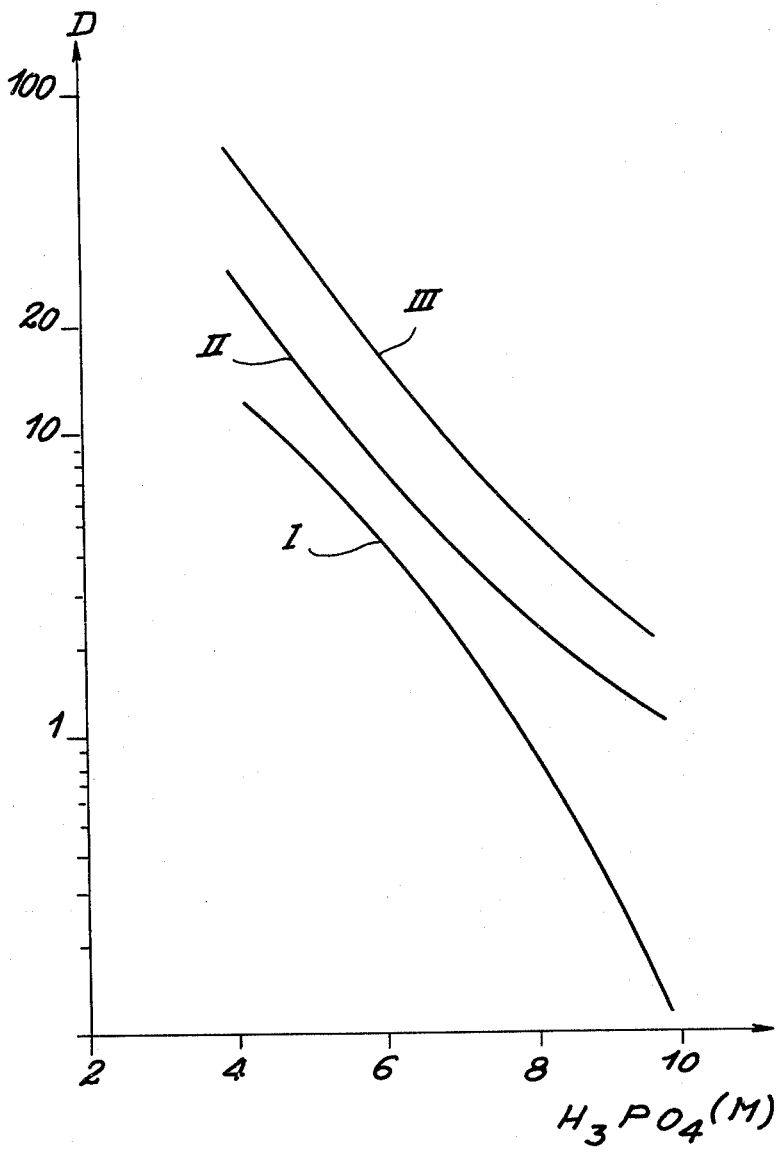
FIG. 2 the variations of the coefficient of partition D of uranium as a function of the $H_3PO_4$ concentration of the aqueous phase for three systems of extractants.

It is apparent from FIG. 2 that the best results with the smallest risk of a variation of the extraction coefficient are obtained when the organic solvent contains 0.36 M of acid organophosphorus compound and 0.14 M of phosphine oxide and that good results are obtained when the molar ratio of the acid organophosphorus compound to the neutral phosphine oxide is 1 to 9.

EXAMPLE 3

This example illustrates the influence of the phosphoric acid concentration of the aqueous solution on the extraction of uranium (VI) at 23° C. by means of the extractant systems I, II and III of table 2, diluted in Hyfrane 120. In this example, extraction is carried out under the same conditions as in example 1.

The results obtained are given in FIG. 2, which represents the variations of the uranium (VI) partition coefficient D as a function of the phosphoric acid concentration of the aqueous phase. In FIG. 2, curves I, II and III respectively illustrate the results obtained with the extractant systems I, II and III of table 2.

In all cases, the uranium partition coefficient D decreases as a function of the phosphoric acid concentration but it decreases less significantly with the extractant systems II and III of the invention.

EXAMPLE 4

This example illustrates the influence of the temperature on the extraction of uranium (VI). Extraction is carried out under the same conditions as in examples 2 and 3 by varying the temperature from 10° to 60° C. and by using extractant systems I to IV of table 2 diluted in Hyfrane 120. The results obtained are shown in FIG. 3 where curves I, II, III and Iv respectively relate to systems I, II, III and IV.

Figure 3:
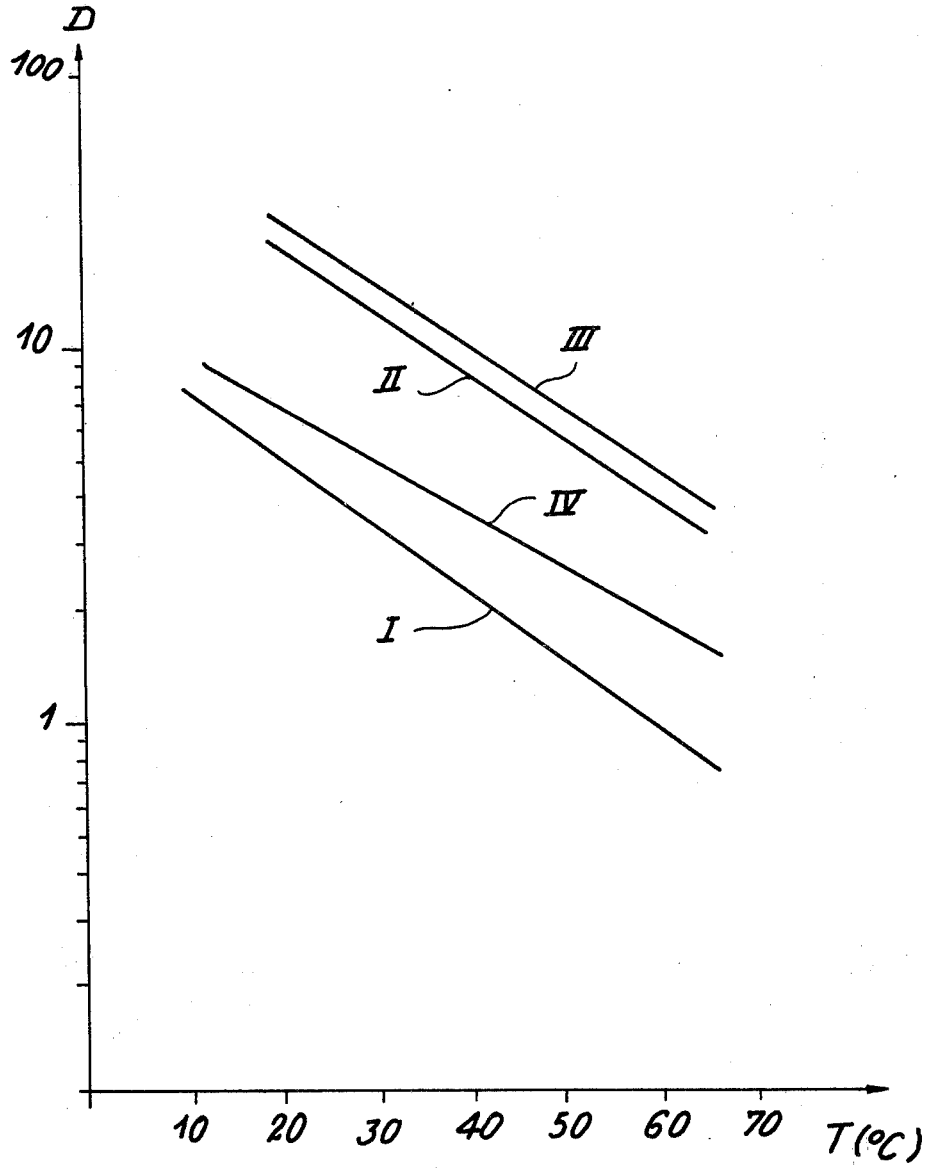
FIG. 3 variations in the coefficient of partition D of uranium as a function of the temperature for different system of extractants.

It is apparent from FIG. 3 that the uranium (VI) partition coefficient decreases when the temperature increases. However, at 60° C., the coefficient of partition obtained with system III according to the invention is still twice higher than that contained at 40° C. with the prior art system I.

EXAMPLE 5

In this example, the uranium is extracted from a 6 M phosphoric acid solution containing 1.06 g/l of uranium (VI) and 4.70 g/l of iron (III), using system of extractant III of table 2 diluted in Hyfrane 120 and working under the conditions as described in example 1. However, the coefficients of partition of uranium (VI) and iron (III) are determined after different extraction times. The results obtained are given in FIG. 4, which shows the evolution of the extraction level (as a percent) in the organic phase of uranium (curve 1) and iron (curve 2) as a function of the extraction time (in seconds).

Figure 4:
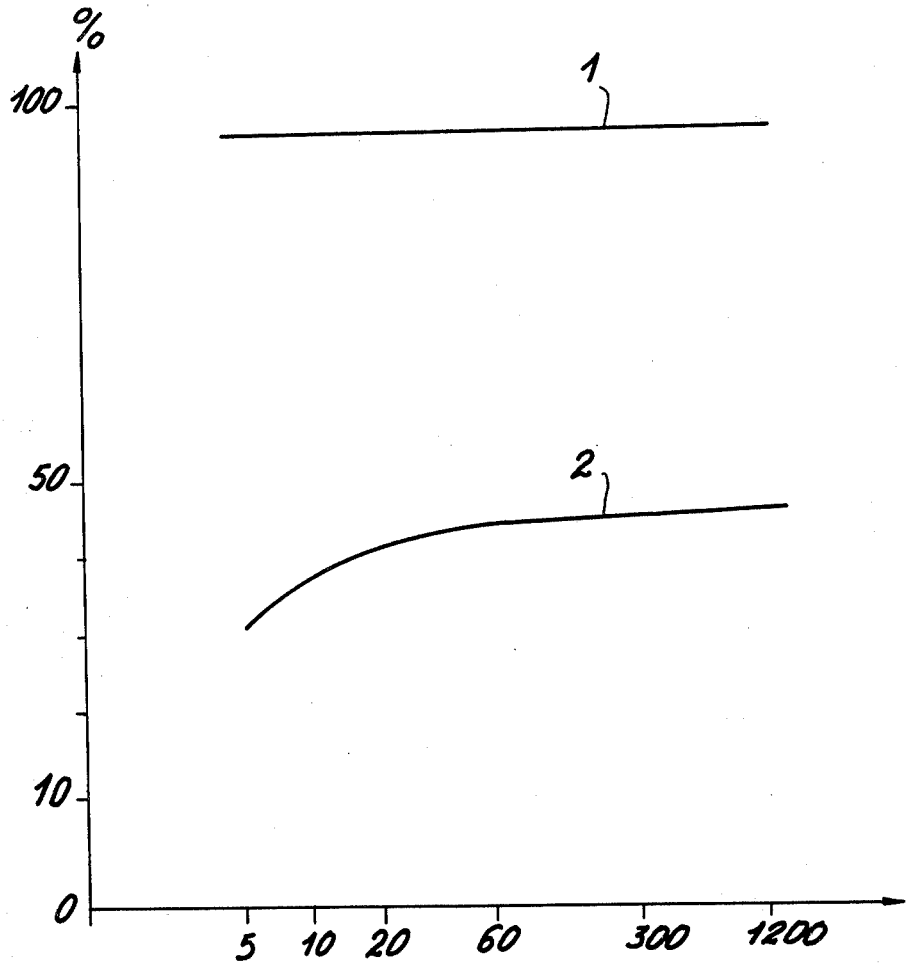
FIG. 4 variations in the coefficients of partition of uranium (curve 1) and iron (curve 2) as a function of the extraction time.

It is apparent from FIG. 4 that the uranium (VI) is extracted more rapidly. The equilibrium selectivity defined by formula:

$$\alpha = \frac{D_{UVI}}{D_{FeIII}}$$

is equal to 20 and can be doubled when using contact times less than 5 seconds.

EXAMPLE 6

In this example, the uranium is recovered from an industrial phosphoric acid solution titrating 27% in $P_2O_5$ and 130 mg/l of uranium using as the organic solvent extractant systems I, III and IV of table 2 diluted in the product sold under the trade mark Escaid 110, which is a desaromatized kerosine with a 0.5 M concentration of acid organophosphorous compound and a 0.125 M concentration of phosphine oxide.

To carry out extraction, 8 fractions of the phosphoric acid are successively contacted with an organic solvent fraction, each fraction having a volume of 50 ml. A double-jacketed separating funnel thermostatically controlled to 40° C. and manually stirred for 5 minutes is used. After then decanting two phases, the uranium content of the organic solvent and the uranium content of the phosphoric acid solution are determined. The results obtained are given in FIG. 5, whereof curves I, III and IV respectively illustrate the uranium (VI) content (in mg/l) of the organic solvent as a function of the uranium content (mg/l) of the phosphoric acid for extractant systems I, III and IV.

Figure 5:
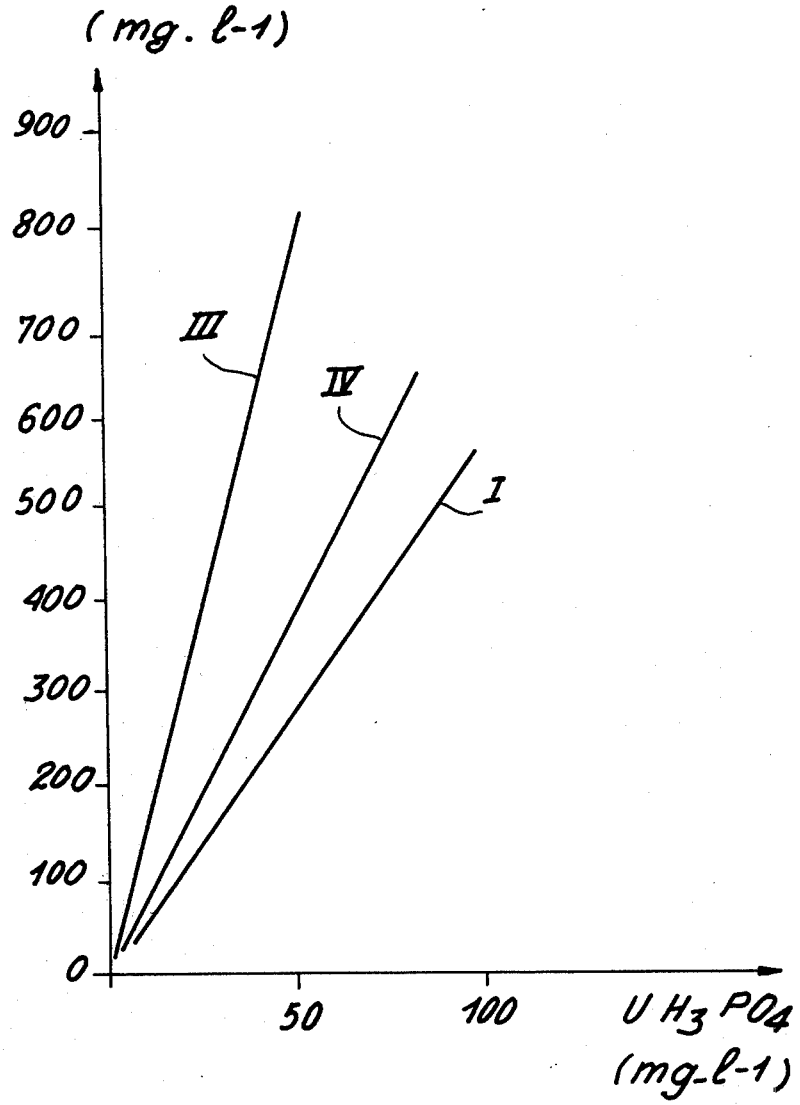
FIG. 5 variations in the uranium content ($mg.l^{-1}$) of the organic solvent as a function of the uranium content of the aqueous phase for three systems of extractants.

In FIG. 5, it can be seen that extractant system III according to the invention is superior to the prior art extractant systems I and IV.

Figure 6:
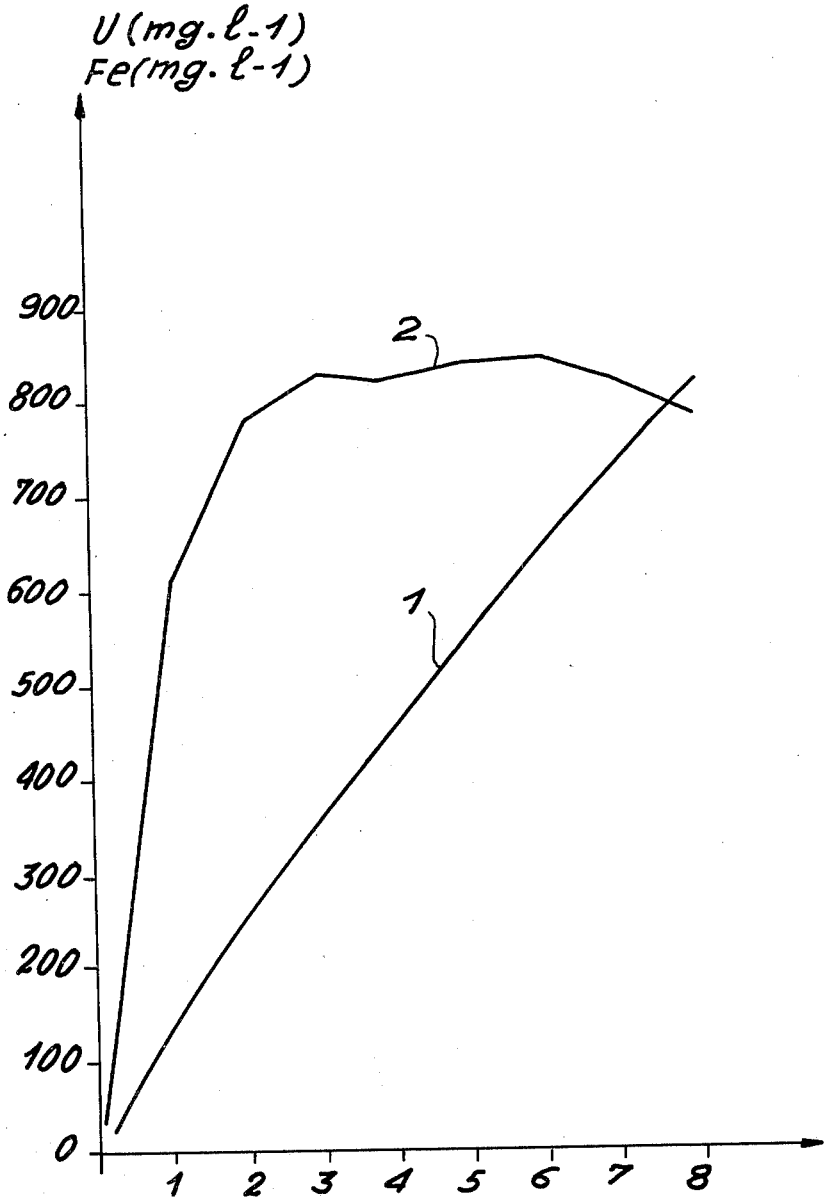
FIG. 6 variations of the uranium content (curve 1) and iron content (curve 2) of the organic solvent as a function of the number of contacts.

FIG. 6 illustrates the results obtained in connection with the extraction of iron as a function of the number of contacts. Curve 2 represents the evolution of the iron concentration of the organic solvent as a function of the number of contacts and curve 1 represents the evolution of the uranium concentration of the organic solvent as a function of the number of contacts when using extractant system III according to the invention.

The thus obtained organic solvent, which contains 798 mg/l of uranium and 775 mg/l of iron is contacted with a 140 g/l ammonium carbonate solution and 0.5 m of $NH_4OH$ for re-extracting the uranium in solution and separating the iron in the form of hydroxide. At the end of this re-extraction, the organic phase only contains 0.4 mg/l of uranium and 1 mg/l of iron.

The exploitation of the curves of FIG. 5 according to the MacCabe and Thiele method leads to the following conclusions. With a 99% uranium recovery level, a concentration factor of 6.1 is obtained for 5 stages with extractant system III, whereas in the case of the prior systems (I and IV) concentration factors of respectively 2.3 and 3.0 are obtained.

Thus, system of extractant III extracts the uranium more than 3 times better than the conventional prior art system (system I) and more than twice as well as prior art system IV. Therefore, it is possible to reduce the organic phase volume and consequently limit the concentrations of ammonium carbonate and ammonia during the re-extraction operation.

Example 7

Different mixtures of extractants are used for recovering the uranium from industrial phosphoric acid having the following characteristics:

density: 1.292
redox potential: 370 mV/Ecs
viscosity: 4.65 cp
uranium content: 135 $mg.l^{-1}$
$PO_4$ content: 484.8 $g.l^{-1}$ ($P_2O_5$=28.04%)
F content: 15.8 $g.l^{-1}$
V content: 174 $mg.l^{-1}$
$SO_4$ content: 18.26 $g.l^{-1}$
Fe content: 2.12 $g.l^{-1}$
Al content: 1.62 $g.l^{-1}$.

The organic solvents used contain the system of extractants I, III, IV or V of the attached table 2 and a diluent constituted by kerosine known under the trade name ISOPAR L. In each solvent tested, the phosphine oxide content is 0.125 M and the acid organophosphorus compound content is 0.500 M.

Extraction is carried out by contacting one volume of aqueous phosphoric acid solution with one volume of organic solvent at 39° C. accompanied by stirring for about 5 minutes. The two phases are then separated and sampled. Each of them is analysed to obtain their uranium concentrations and iron concentrations, followed by the determination of the uranium partition coefficient D and the iron partition coefficient D. The results obtained are given in table 3. It can be seen that the organic solvent containing the system of extractants according to the invention, i.e. acid organophosphorus compound HBIDIBOPP associated with a phosphine oxide such as POX 11 or TOPO make it possible to obtain considerably improved results compared with extractant systems I and IV according to the prior art.

In another series of tests, extraction is carried out by successively contacting, as in example 6, 8 industrial phosphoric acid fractions with 1 fraction of each of the organic solvents of table III to obtain equilibrium curves identical to those shown in FIG. 5. An exploitation of these curves for the different solvents in accordance with the MacCabe and Thiele methods indicates that for obtaining at the outlet of a five-stage extraction installation phosphoric acid with a uranium content equal to or below 3–4 $mg.l^{-1}$, the extraction solvent is charged with:

350 $mg.l^{-1}$ of uranium and 78 $mg.l^{-1}$ of iron for extractant system I
450 $mg.l^{-1}$ of uranium and 125 $mg.l^{-1}$ of iron for extractant system IV
1000 $mg.l^{-1}$ of uranium and approx. 1250 $mg.l^{-1}$ of iron for extractant system III and
800 $mg.l^{-1}$ of uranium and approx. 800 $mg.l^{-1}$ of iron for extractant system V.

Thus, with the same treatment efficiency the extractant systems according to the invention lead to solvents with a much higher uranium content.

EXAMPLE 8

Figure 7:
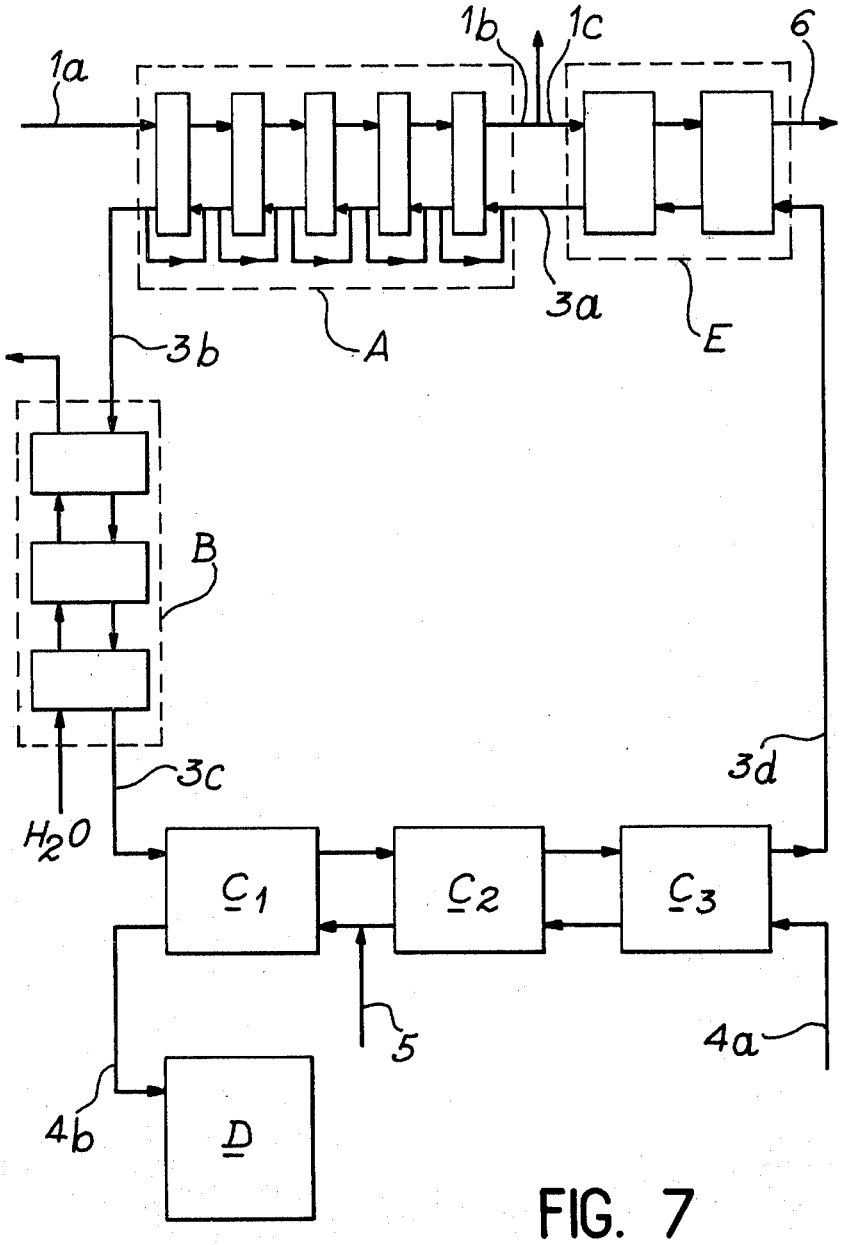
FIG. 7 diagrammatically, a phosphoric acid processing installation for performing the process of the invention.

This example relates to the extraction of the uranium contained in industrial phosphoric acid having the same characteristics as that of example 7 and using the extraction installation of FIG. 7.

In FIG. 7, A designates the uranium extraction unit which comprises five extraction stages, reference B represents a three-stage organic solvent washing unit, references $C_1$, $C_2$ and $C_3$ designate the three uranium re-extraction stages, reference D illustrates the uranium separation unit and reference E designates the two-stage organic solvent reacidification unit.

Following its flocculation and decanting industrial phosphoric acid is introduced by means of line 1*a* into extraction unit A. The acid has previously undergone an oxidation treatment to bring all the uranium into hexavalent form, which also brings the iron into the trivalent state. In extraction unit A, the phosphoric acid is brought into counter current contact with an organic solvent introduced by line 3*a*. This organic solvent consists of a system of extractants constituted by an acid organophosphorus compound and a neutral phosphine oxide diluted in kerosines known under the trade name ISOPAR L, the acid organophosphorus compound concentration in the solvent being 0.5 $mol.l^{-1}$ and the phosphine oxide concentration in the organic solvent being 0.125 $mol.l^{-1}$.

The phosphoric acid solution circulating in the extraction unit at a flow rate maintained at 4 l/h and the organic solvent circulates in countercurrent in the extraction unit, having been introduced at a rate of 1.6 l/h for extractant system I, 1.0 l/h for extractant system IV and 0.54 l/h for extractant system III.

In each extraction stage, part of the organic solvent leaving the stage is recycled, which makes it possible to increase the organic phase volume in contact with the phosphoric acid in extraction unit A all of whose stages are kept at 35° C.

On leaving extraction unit A, the phosphoric acid, which virtually contains no further uranium is discharged by line 1*b* and the organic solvent which contains uranium and iron is discharged by line 3*b*. This solvent then passes into the washing unit which has three stages, where it is washed with water to eliminate the phosphoric ions entrained by the solvent. The phosphoric acid-containing water which leaves the final stage of the washing unit is recycled in the phosphoric acid production plant where it is used for washing or rinsing installations.

On leaving washing unit B, the organic solvent is introduced by line 3*c* into the first re-extraction stage $C_1$. It then circulates in the following stages $C_2$ and $C_3$, stages $C_1$, $C_2$ and $C_3$ being kept at 40° C.

In stages $C_2$ and $C_3$, it is brought into countercurrent contact with a 155 $g.l^{-1}$ ammonium carbonate solution introduced into stage $C_3$ by line 4*a* and in stage $C_1$ it is brought into countercurrent contact with the carbonate solution from stage $C_2$ and with the 200 $g.l^{-1}$ ammonia injected by line 5 into the carbonate solution entering first stage $C_1$. The ammonium flow rate is regulated by means of a valve controlled by a pH-meter, so as to keep the pH of the first stage $C_1$ at 8.2. In the same way, the flow way of the ammonium carbonate solution introduced into the final stage $C_3$ by line 4*a* is regulated so that it corresponds to 15 to 80% of the stoichiometric quantity necessary for neutralizing on the one hand the acid organophosphorus compound and to transform on the other hand the uranium into uranyl ammonium tricarbonate.

During re-extraction, the organic solvent which contains uranium and iron and which is firstly in contact with the ammonia is gradually transformed into a hydrated ammonium salt and the aqueous phase, which is moving in countercurrent, is enriched with uranium and iron. The ammonium carbonate reacts with the uranium to form uranyl ammonium tricarbonate which remains in solution and the iron is precipitated in the form of hydroxide, which is separated by filtration. The uranyl ammonium tricarbonate-containing aqueous stage leaves the first re-extraction stage $C_1$ via line 4*b* and is then passed to the uranium separation unit D.

In this unit, the uranium can be separated from the solution either in the form of an oxide or in the form of sodium uranate. To obtain the uranium in the form of uranium trioxide, the uranyl ammonium tricarbonate solution is subjected to air bubbling in a reactor at between 90° and 100° C. for approximately 6 hours. The precipitate is then filtered and washed with water. After drying at 120° C. and roasting at approximately 400° C., the uranium trioxide is obtained. To obtain the uranium in the form of sodium uranate using soda and a temperature of approximately 80° C. neutralization takes place of the uranyl ammonium tricarbonate solution, which has previously been degased by air bubbling at 90° C. to eliminate the carbon dioxide and ammonia, the uranium then being precipitated by adding sodium hydroxide to the solution and working at a temperature of 80° C. for 1 hour. After filtering and washing with water at 50° C., the sodium uranate is collected and can then be transformed into ammonium diuranate or uranium trioxide.

On leaving the third re-extraction stage $C_3$ the uranium-extracted organic solvent is discharged by line 3*d* and passed to the purification and reacidification unit E which is in two stages where it is treated by means of phosphoric acid introduced by line 1*c*. This phosphoric acid forms a fraction of the phosphoric acid leaving extraction unit A by means of line 1*b*. By bringing the organic solvent into contact with the phosphoric acid, the ammonium salt of the extraction agent is decomposed, which leads to the formation of ammonium phosphate discharged by line 6 and to the obtaining of acidified organic solvent, which can be recycled by line 3*a* for reuse in extraction unit A.

It is pointed out that the ammonium phosphate recovered in this way can be directly commercially used or can be used in fertiliser production units.

In this installation, various tests for the extraction of uranium from industrial phosphoric acid are performed using organic solvents containing extractant systems I, III or IV of table 3 for the treatment of 472 liters of phosphoric acid for a period of 118 hours. Of the latter period, 73 hours are used for testing extractant system III according to the invention, corresponding to 282 liters of treated phosphoric acid. In each case, samples are taken of the organic phase and the aqueous phase in each of the extraction stages after reaching equilibrium and their uranium content and possibly their iron content is determined. The results obtained are given in Table 4.

On the basis of these results, it is apparent that it is possible to reach a charge of 1003 $mg.l^{-1}$ with the solvent according to the invention by using only five extraction stages. This solvent can be charged to 1220 $mg.l^{-1}$ by using a sixth stage and at the outlet phosphoric acid is obtained, which contains less than 2 mg/l of uranium. In this case, the organic solvent flow rate is 0.43 l/h.

In the case of the prior art solvents, a five-stage extraction installation only makes it possible to charge the organic solvent to 300 or 540 $mg.l^{-1}$, if phosphoric acid containing less than 2 $mg.l^{-1}$ of uranium is to be obtained at the outlet.

Moreover, these results show that substantially the theoretical uranium charge of the solvent is obtained.

TABLE 1

| Compound acid No. | Nature of the alkyl chains ($R_4$=$R_5$) of the compounds of formula II | Phosphine oxide POX 11 23° C. | POX 11 40° C. | TOPO 23° C. |
|---|---|---|---|---|
| 1 ($D_2EHPA$) | ethyl-2-hexyl $n\text{-}C_4H_9-CH(C_2H_5)-CH_2$ | 6.3 | 3.4 | 4.3 |
| 2 | butoxyethyl $nC_4H_9-O-C_2H_4$ | 5.2 | 4.1 | 4.9 |
| 3 | hexoxyethyl $nC_6H_{13}-O-C_2H_4$ | 10.1 | 8.1 | — |
| 4 | pentoxypropyl $nC_5H_{11}-O-C_3H_6$ | 3.6 | — | — |
| 5 | ethyl-2-hexoxyethyl $C_4H_9-CH(C_2H_5)-CH_2-O-C_2H_4$ | 12.9 | — | — |
| 6 | octoxyethoxyethyl $NC_8H_{17}-O-C_2H_4-O-C_2H_4$ | 2.2 | — | — |
| 7 | 1,3-dipropoxy-2-propyl $(C_3H_7-O-CH_2)_2CH$ | 15.5 | 8.2 | 9.7 |
| 8 (HBIDIBOPP) | 1,3-dibutoxy-2-propyl $(C_4H_9-O-CH_2)_2CH$ | 18.5 | 9.7 | 15.5 |

TABLE 2

| System of extractants. | Acid organophosphorus compounds (0.5M) | Phosphine oxide (0.125M) |
|---|---|---|
| No. I | Compound 1 of table I | TOPO |
| No II | Compound 7 of table I | POX 11 |
| No III | Compound 8 of table I | POX 11 |
| No IV | Compound 1 of table I | POX 11 |
| No V | Compound 8 of table 1 | TOPO |

TABLE 3

| System of extractants | Acid compound (0.5M) | Phosphine oxide (0.125M) | $D_U$ | $F_{Fe}$ |
|---|---|---|---|---|
| I | $D_2EHPA$ (compound No 1) | TOPO | 4.2 | 0.04 |
| III | HBIDIBOPP (compound No 8) | POX 11 | 18.3 | 0.80 |
| IV | $D_2EHPA$ | POX 11 | 9.4 | 0.06 |
| V | HBIDIBOPP | TOPO | 14.0 | 0.40 |

TABLE 4

| STAGE | | No 1 | | | No 2 | | No 3 | | No 4 | | No 5 | | No 6 | |
|---|---|---|---|---|---|---|---|---|---|---|---|---|---|---|
| Organic (o) or aqueous (a) phase | | o | o | a | o | a | o | a | o | a | o | a | o | a |
| Concentrations ($mgl^{-1}$) | | U | Fe | U | U | U | U | U | U | U | U | U | U | U |
| Extractant systems | Theoretical solvent charge $mgl^{-1}$ | | | | | | | | | | | | | |
| I D2EHPA—TOPO flow rate = 1.6 l/h | 350 | 300 | — | 45 | 106 | 20 | 53 | 8 | 24 | 4 | 9 | <2 | | |
| II HBIDIBOPP—POX 11 flow rate = 0.54 l/h | 1000 | 1003 | 1394 | 54 | 400 | 25 | 170 | 12 | 76 | 4 | 30 | <2 | | |
| 0.43 l/h | 1250 | 1220 | 1490 | 63 | 640 | 31 | 300 | 15 | 145 | 9 | 70 | 4 | 35 | ≦2 |
| IV $D_2EHPA$—POX 11 flow rate 1.0 l/h | 420 | 540 | — | 66 | 250 | 38 | 133 | 18 | 71 | 9 | 30 | <2 | | |

What is claimed is:

1. A process for the recovery of uranium (VI) present in a phosphoric acid solution by contacting the said solution with an organic solvent able to extract the uranium, wherein the organic solvent comprises a system of extractants respectively constituted by:

(a) a neutral phosphine oxide of the formula:

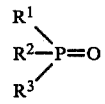

(I)

in which $R^1$, $R^2$ and $R^3$, are selected from the group consisting of alkyl, aryl or alkoxyalkyl radicals, and (b) an acid organophosphorus compound of the formula

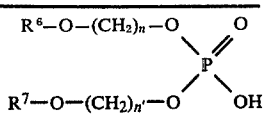

(III)

in which $R^6$ and $R^7$, which are selected from the group consisting of alkyl or aryl radicals, and n and n', which can be identical or different are numbers equal to 2 or 3.

2. A process according to claim 1, wherein n and n' are equal to 2 and $R^6$ and $R^7$ are alkyl radicals having at least 8 carbon atoms.

3. A process according to claim 1, wherein n and n' are equal to 2 and $R^6$ and $R^7$ represent the ethyl-2-hexyl radical.

4. A process according to claim 1 which comprises re-extracting the uranium extracted in the organic solvent by passing said extracted uranium through an apparatus comprising at least two stages, contacting said extracted uranium in each stage with an aqueous ammonium carbonate solution in countercurrent relationship with respect to the organic solvent and introducing said ammonium carbonate solution into the final stage in a quantity such that it represents 50 to 80% of the stoichiometric quantity necessary for neutralizing the acid organophosphorus compound and for transforming the uranium present in the organic solvent into uranyl ammonium tricarbonate, and adding ammonia in the form of a gas or an aqueous solution to the ammonium carbonate solution circulating in the first stage in order to keep the pH of the final stage at a value between 8 and 9.5.

5. A process for the recovery of uranium (IV) present in a phosphoric acid solution by contacting the said solution with an organic solvent able to extract the uranium, wherein the organic solvent comprises a system of extractants respectively constituted by:

(a) a neutral phosphine oxide of the formula:

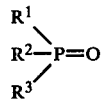

(I)

in which $R^1$, $R^2$ and $R^3$, are selected from the group consisting of alkyl, aryl or alkoxyalkyl radicals, and (b) an acid organophosphorus compound of formula

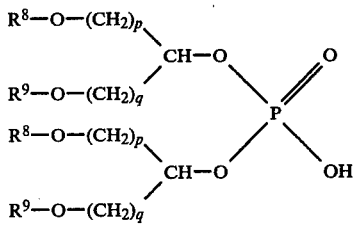

(IV)

in which $R^8$ and $R^9$, are selected from the group consisting of alkyl or aryl radicals, and p and q which can be the same or different, are equal to 1 or 2.

6. A process according to claim 5, wherein p and q are equal to 1 and $R^8$ and $R^9$ are alkyl radicals having at least 4 carbon atoms.

7. A process according to claim 5, wherein p and q are equal to 1 and the radicals $R^8$ and $R^9$ represent a butyl radical.

8. A process according to claim 1 or claim 5, wherein the neutral phosphine oxide is tri-n-octylphosphine oxide.

9. A process according to claim 1 or claim 5, wherein the molar ratio of the acid organophosphorus compound to the neutral phosphine oxide is from about 1 to 9.

10. A process according to claims 1 or 5, wherein in the neutral phosphine oxide formula, at least one of the radicals $R^1$, $R^2$ and $R^3$ is an alkoxyalkyl radical.

11. A process according to claim 10, wherein the neutral phosphine oxide is di-n-hexyl-octoxymethylphosphine oxide.

* * * * *